US007338339B2

(12) United States Patent
Mendel

(10) Patent No.: US 7,338,339 B2
(45) Date of Patent: Mar. 4, 2008

(54) HOOP-TYPE AMUSEMENT DEVICE

(76) Inventor: Nancy W. Mendel, 321 N. Lakeway, Palm Beach, FL (US) 33480

( * ) Notice: Subject to any disclaimer, the term of this patent is extended or adjusted under 35 U.S.C. 154(b) by 309 days.

(21) Appl. No.: 10/953,428

(22) Filed: Sep. 29, 2004

(65) Prior Publication Data

US 2005/0095950 A1 May 5, 2005

Related U.S. Application Data

(63) Continuation-in-part of application No. 10/446,925, filed on Sep. 29, 2003, now Pat. No. 6,966,814.

(51) Int. Cl.
*A63H 33/02* (2006.01)

(52) U.S. Cl. ..... 446/85; 446/236

(58) Field of Classification Search ..... 446/85, 446/236; 434/214, 277, 278, 284, 291, 292, 434/293; 428/7, 11, 542.2, 542.6
See application file for complete search history.

(56) References Cited

U.S. PATENT DOCUMENTS 3,156,986 A * 11/1964 Strachan ..... 446/115
D208,912 S * 10/1967 Siptrott ..... D19/62
5,569,134 A 10/1996 Nordanger
6,265,035 B1 * 7/2001 Sniderman ..... 428/11
6,309,273 B1 10/2001 Kim
6,431,939 B1 8/2002 Roh
6,722,890 B2 * 4/2004 Kiel ..... 434/290

* cited by examiner

*Primary Examiner*—John A. Ricci
(74) *Attorney, Agent, or Firm*—Malin, Haley & DiMaggio, P.A.

(57) ABSTRACT

An improved hoop assembly that may be alternately formed from a plurality of variously sized and shaped connectable components that are selectively interconnected by the user to form a simple or complex hoop configuration of a particular desired size and shape is disclosed. A plurality of hoop components may have opposing ends that are adapted for mating engagement with other components to form a hoop of a particular size and shape. In addition, the hoop components include connector components that enable hoop components to be connected in concentric configurations. The various components thus may be assembled into a wide variety of hoop configurations, whether annular or otherwise, thereby enhancing fun and enjoyment.

3 Claims, 14 Drawing Sheets

HOOP-TYPE AMUSEMENT DEVICE

CROSS REFERENCE TO RELATED APPLICATIONS

This application is a continuation-in-part of U.S. patent application Ser. No. 10/446,925, filed Sep. 29, 2003 now U.S. Pat. No. 6,966,814.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates, in general, to hoop-type amusement devices and, more particularly, to an improved hoop-type device comprised of interconnected components of various shapes that may be disconnected, re-arranged, and re-connected into a wide variety of configurations.

2. Description of the Background Art

The HULA HOOP® is an amusement device that was initially introduced by Wham-O, Inc. in the early 1950's. HULA HOOP is a registered trademark of Wham-O, Inc. Since introduction, the HULA HOOP has enjoyed widespread use as a device for physical exercise and amusement used by men, women, and children of all ages. The classic HULA HOOP is formed from a hollow piece of plastic tubing having connected ends so as to form an annular shape having a fixed diameter. The HULA HOOP is generally placed around a users waist, legs, arms, or even neck, and user gyrations cause the HULA HOOP to rotate about the user.

While widely popular, the classic HULA HOOP is burdened with significant limitations. Specifically, the simple annular shape of the HULA HOOP limits its functionality and playing method, such that the user is merely able to rotate the hoop about their waist often causing the user to quickly become bored. Furthermore, the simple hoop structure is further incapable of adjustment of either size or shape thereby limiting appeal.

In an effort to overcome such disadvantages and limitations, a variety of improvements have been proposed and used in the art of hoop-type amusement devices. For example, in an effort to improve playability and/or enhance functionality, luminous hoops, glow-in-the-dark hoops, and fluid filled hoops have been developed and used in the art. Nevertheless, there exists a need for further improvements in technology relating to hoop-type play devices to enhance enjoyment and playability.

SUMMARY OF THE INVENTION

The present invention provides an improved hoop assembly that may be alternately formed from a plurality of variously sized and shaped connectable components that are selectively interconnected by the user to form a simple or complex hoop configuration of a particular desired size and shape. Accordingly, as used herein, the term "hoop" may refer to a wide variety of shapes, including annular, square, rectangular, triangular, polygonal, etc. A plurality of hoop components may have opposing ends that are adapted for mating engagement with other components to form a hoop of a particular size and shape. In addition, the hoop components may include connector components that enable hoop components to be connected as more fully discussed herein below. The various components thus may be assembled into a wide variety of hoop configurations, whether annular or otherwise, thereby enhancing fun and enjoyment.

Accordingly, it is an object of the present invention to provide an improved hoop-type amusement device.

Another object of the present invention is to provide a hoop-type amusement device formed of a plurality of connectable components.

Still another object of the present invention is to provide a plurality of connectable components adapted for assembly by a user into a variety of hoop sizes and shapes.

Yet another object of the present invention is to provide a hoop assembly formed of connected components having radially inner and outer structures adapted for connecting various components, whether annular or non-annular, in a generally concentric configuration.

DETAILED DESCRIPTION OF THE INVENTION

With reference now to the drawings FIGS. 1-14 depict an hoop-type amusement device, generally referenced as 10, according to a preferred embodiment of the present invention. The present invention primarily relates to the use of connectable components that are selectively configurable into variously sized and shaped hoop configurations, including composite configurations, as depicted in FIGS. 1, and 7-10. More particularly, the present invention provides an improved hoop-type amusement device including annular components and connection components for use in connecting other annular and/or non-annular components together to form more complex configurations.

Figure 1:
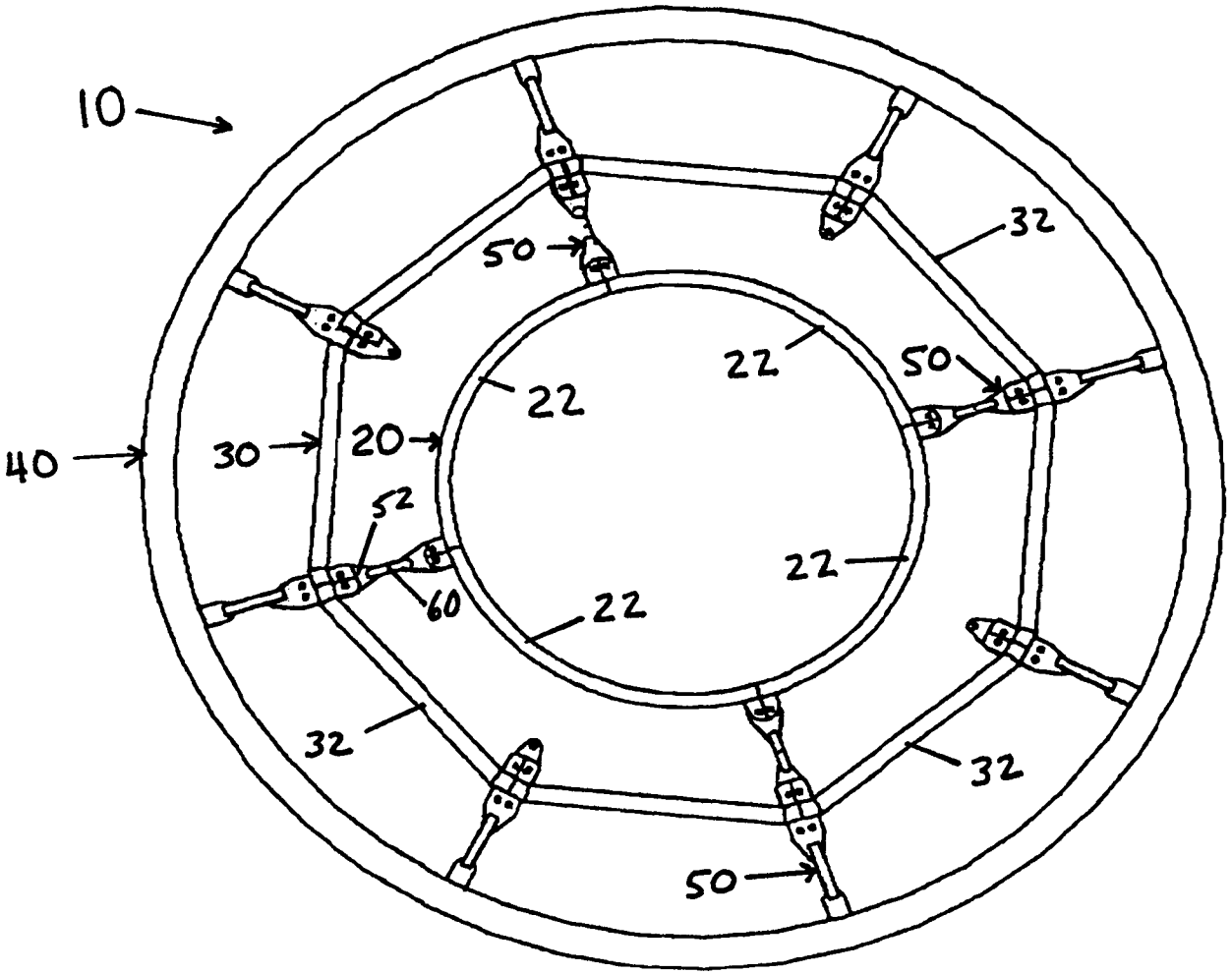
FIG. 1 depicts hoop-type amusement device consisting of a plurality of connected annular and non-annular components in accordance with the present invention.

By way of example FIG. 1 illustrates a complex hoop-type amusement device 10 in accordance with the present invention. Device 10 includes a circular hoop component 20 concentrically disposed within and an octagonal component 30 and an outer annular component 40. Circular hoop component 20, octagonal component 30, and outer annular component 40, are connected in a concentric configuration by connectors, generally referenced as 50. The present invention contemplates that connectable components may be of any suitable shape including: arcuate, straight, angular (obtuse, acute, or right angled), circular, square, triangular, rectangular, polygonal, or any suitable complex configuration. The components may be fabricated from hollow or solid plastic tubing, or from any other suitable material.

Figure 4:
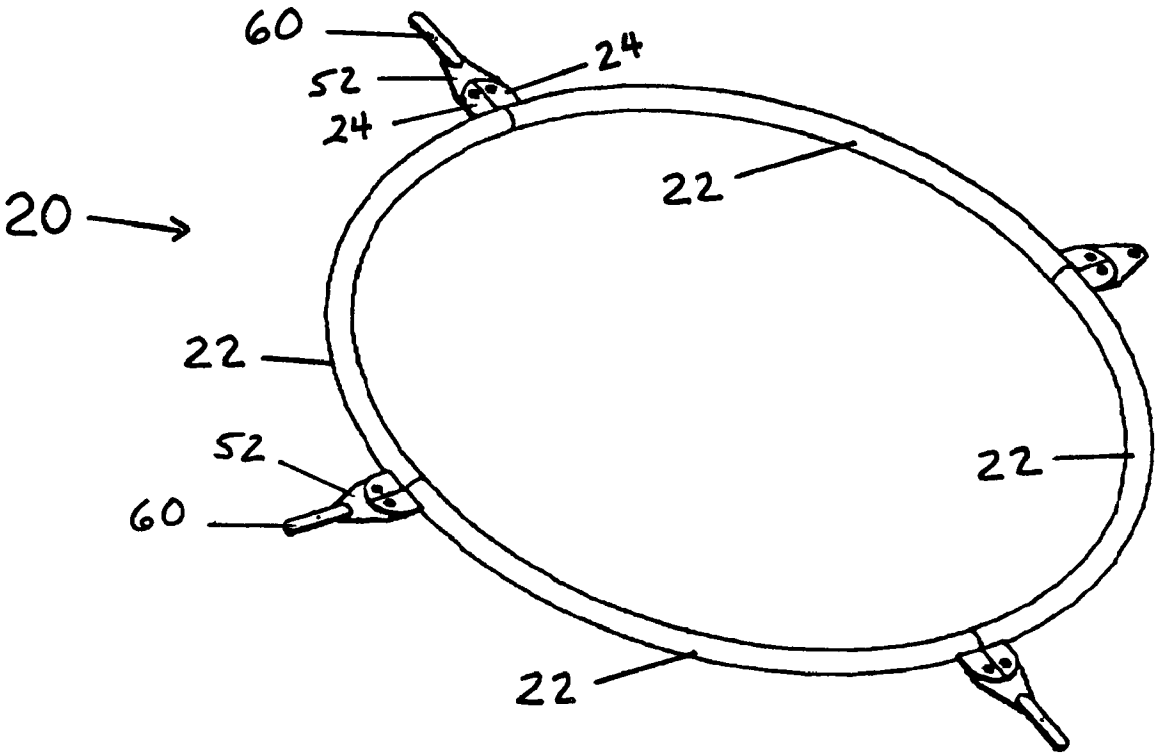
FIG. 4 depicts the device shown in FIG. 3 with the outer non-annular components removed.
Figure 5:
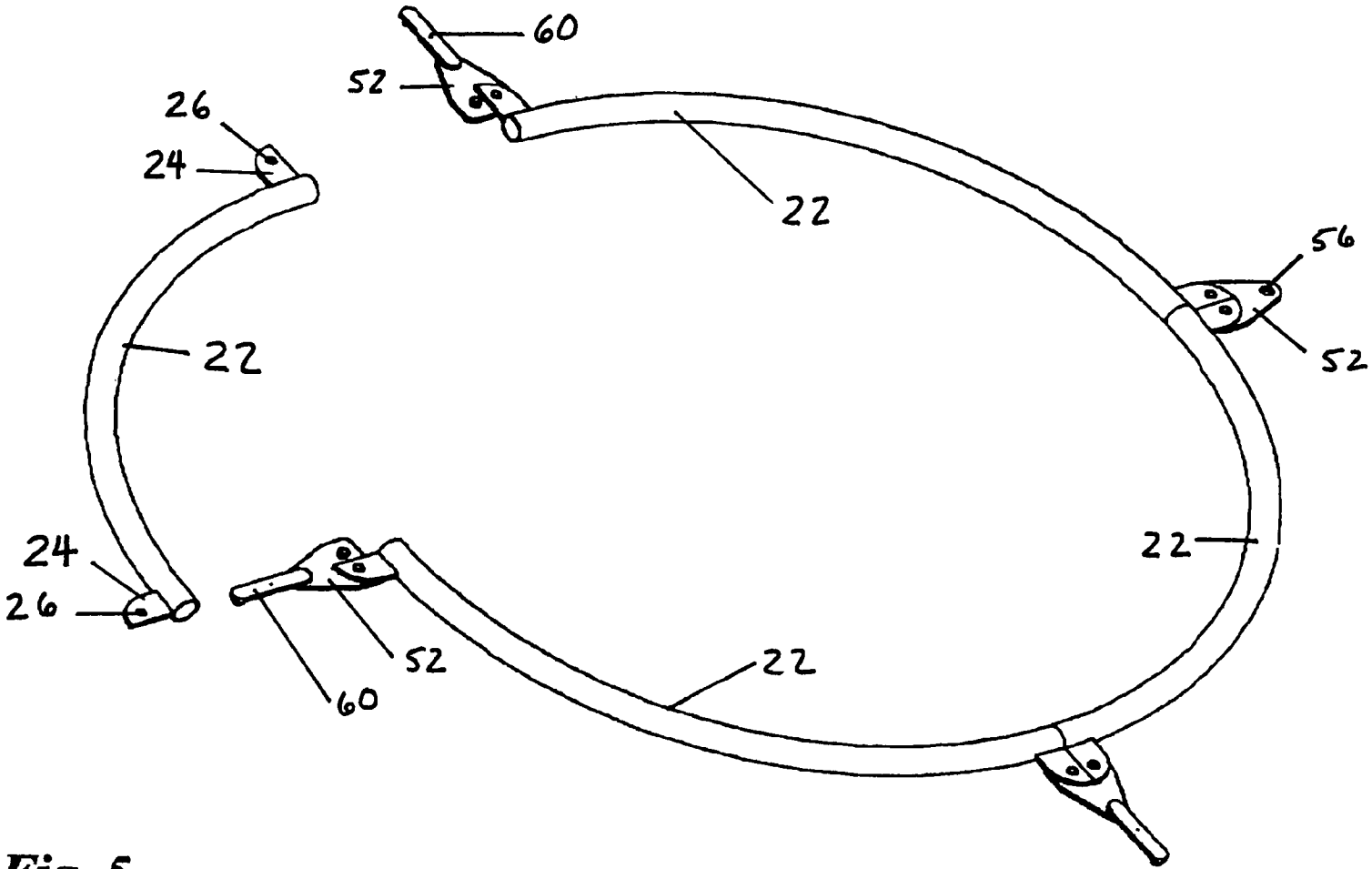
FIG. 5 depicts the device shown in FIG. 4 in a partially disconnected configuration.
Figure 6:
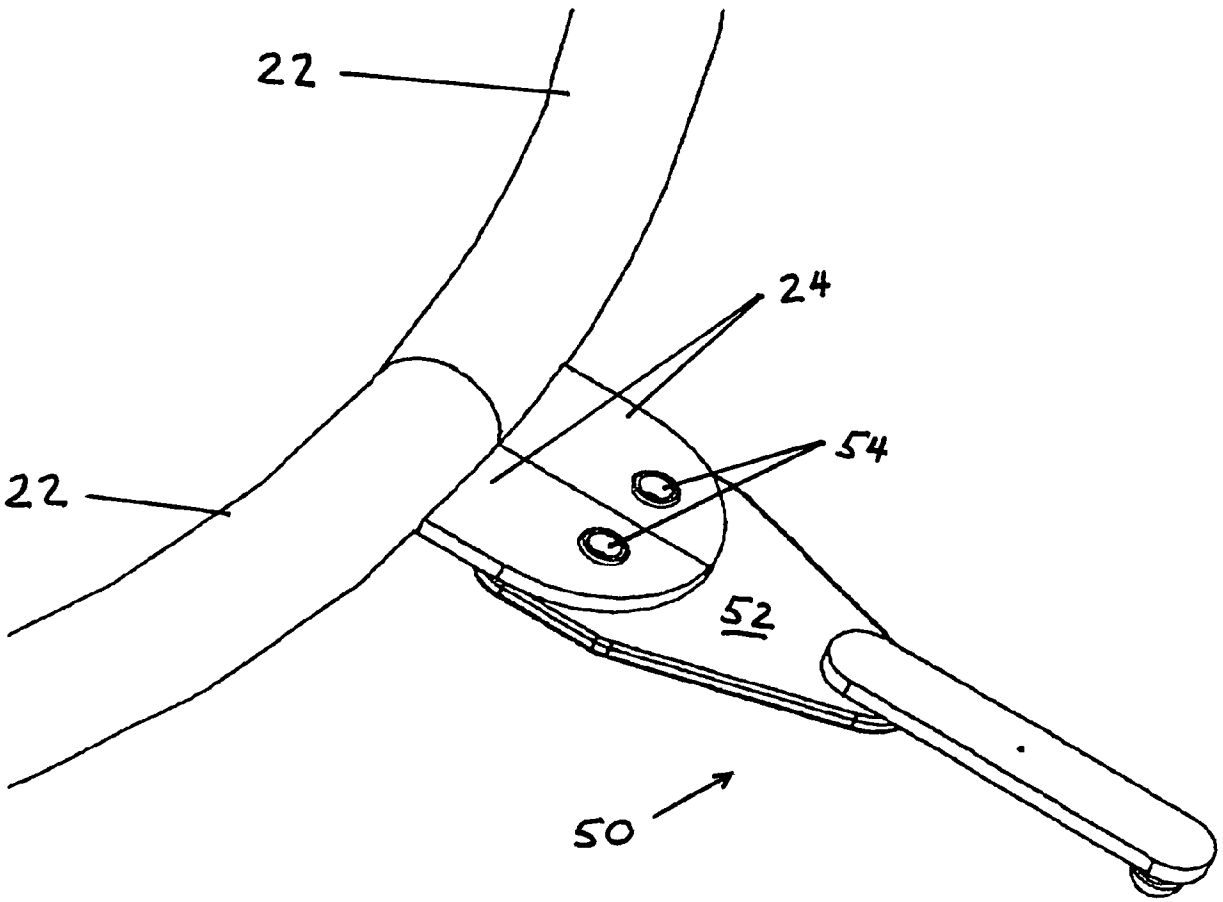
FIG. 6 is a detailed view of connection components.

In a preferred embodiment, a hoop-type amusement device may be assembled by selective connection of subcomponents. For example, as best depicted in FIGS. 4 and 5, hoop component 20 is comprised of four connected arcuate segments 22 connected by attachable connector assembly 50, and more particulary a bracket portion thereof referenced as 52. Each arcuate segment 22 includes opposing end portions, and each end portion has a projecting tab 24 defining an aperture 26. Hoop component 20 is formed by placing four arcuate segments 22 in adjacent relation to form a ring shape and securing the segments by attachment of connector brackets 52. More particularly, each connector bracket 52 includes an end portion having first and second projecting pins 54, which projecting pins are sized and spaced for inserted engagement within apertures 26 defined by projecting tabs 24 on adjacently positioned arcuate segments 22 as best illustrated in FIGS. 5 and 6. Each connector bracket 52 further includes an opposing end portion defining an aperture 56 for further connectability as more fully discussed herein below.

Figure 2:
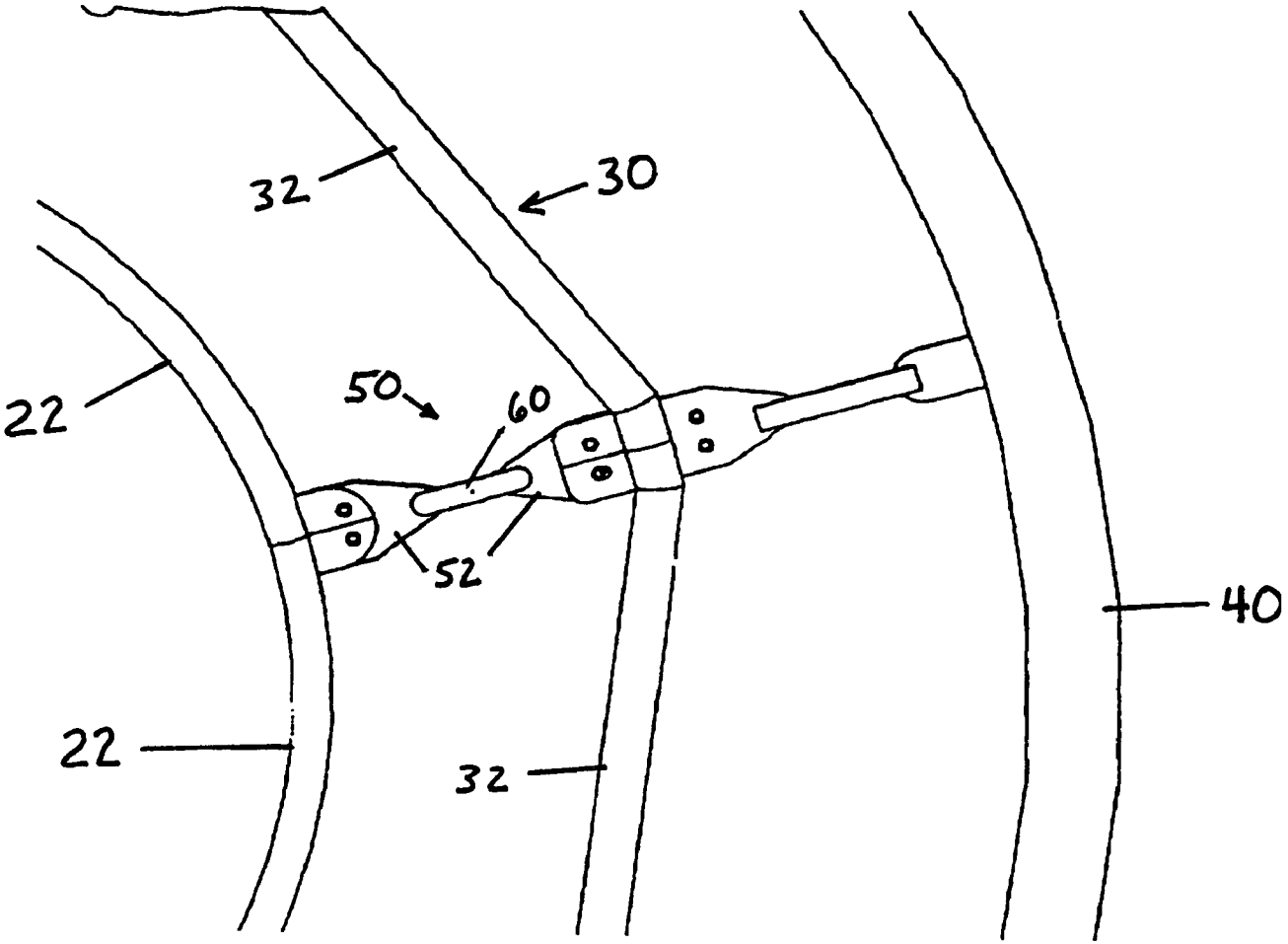
FIG. 2 is a detailed view of component connections.

Octagonal component 30 may be fabricated by connection of eight generally straight components, individually referenced as 32, using eight brackets 52. In a similar manner as discussed above, each straight component 32 includes opposing end portions, and each end portion has a projecting tab 34 defining an aperture 46. Octagonal component 30 is formed by placing eight straight components 32 in adjacent relation to form an octagon shape, and securing the components by attachment of connector brackets 52. As previously disclosed, the connector bracket projecting pins 54 are sized and spaced for inserted engagement within apertures 36 defined by projecting tabs 34 on adjacently positioned straight components 32 as best illustrated in FIGS. 2 and 3.

An octagonal component 30 may be connected to hoop component 20 by a connecting strap 60. More particularly, as disclosed hereinabove, each connector bracket 52 defines an aperture 56. Each connecting strap 60 includes opposing end portions having projecting pins 62. Bracket apertures 56 are sized for receiving and retaining projecting pins 62 therein in a press fit connection. Accordingly, as best depicted in FIGS. 1-3, the previously fabricated hoop component 20 and octagonal component 30 may be connected in concentric relation by linking radially opposed brackets 52 radially disposed on component 20 with those disposed on octagonal component 30 using connecting straps 60 by insertion of strap pins 62 into bracket apertures 56 thereby linking the two components. FIG. 2 provides a detail view of the connection assembly 50, including radially opposed brackets 52 connected each connected by a strap 60. FIG. 3 depicts the components in the connected configuration.

The present invention further contemplates additional components, such as outer annular component 40 depicted in FIG. 1. Outer annular component 40 is also adapted for attachment to a complex hoop assembly in a manner similar to that described hereinabove. More particularly, outer annular component 40 is connected in concentrically outward relation with octagonal component 30 by connectors 52 and connecting straps 60. As should be apparent, the present invention provides a system that may be adapted to form other hoop shapes as the drawings merely illustrate a few of the many possible combinations.

Figure 3:
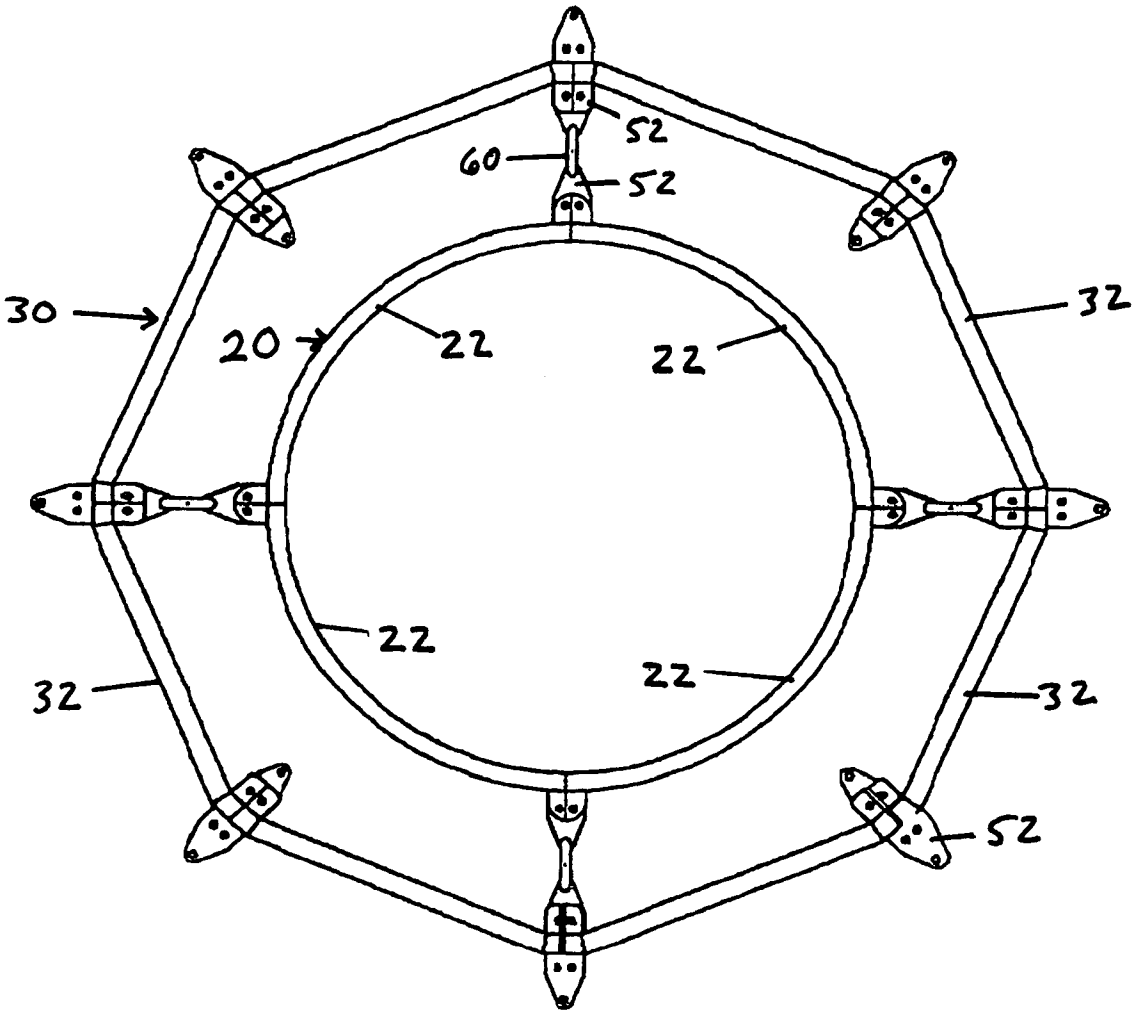
FIG. 3 depicts the device shown in FIG. 1 with the outer annular ring component removed.
Figure 7:
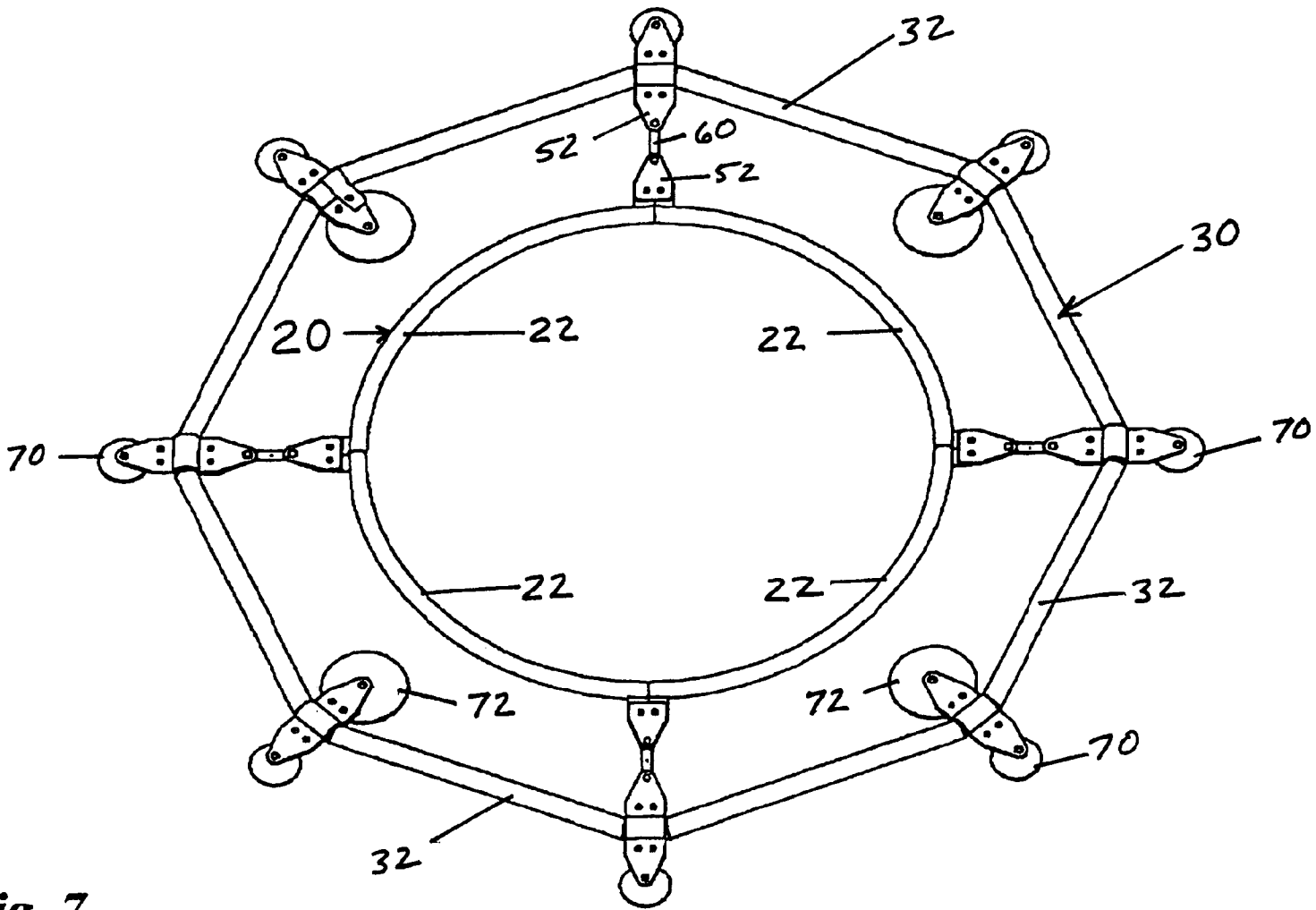
FIGS. 7-10 depict alternate configurations for a hoop-type amusement device consisting of annular and non-annular connected components in accordance with the present invention.

FIG. 7 depicts a hoop configuration wherein inner hoop component 20 is concentrically connected to octagonal component 30 as described in FIG. 3 above, except that disk shaped members referenced as 70 and 72 are connected to octagonal component 30 at selective locations. More particularly, each disk shaped member 70 defines an axially aligned projecting hub sized for inserted engagement within an aperture 56 on brackets 52. While FIG. 7 depicts disk shaped members, the present invention contemplates any suitable configuration or shaped member.

Figure 8:
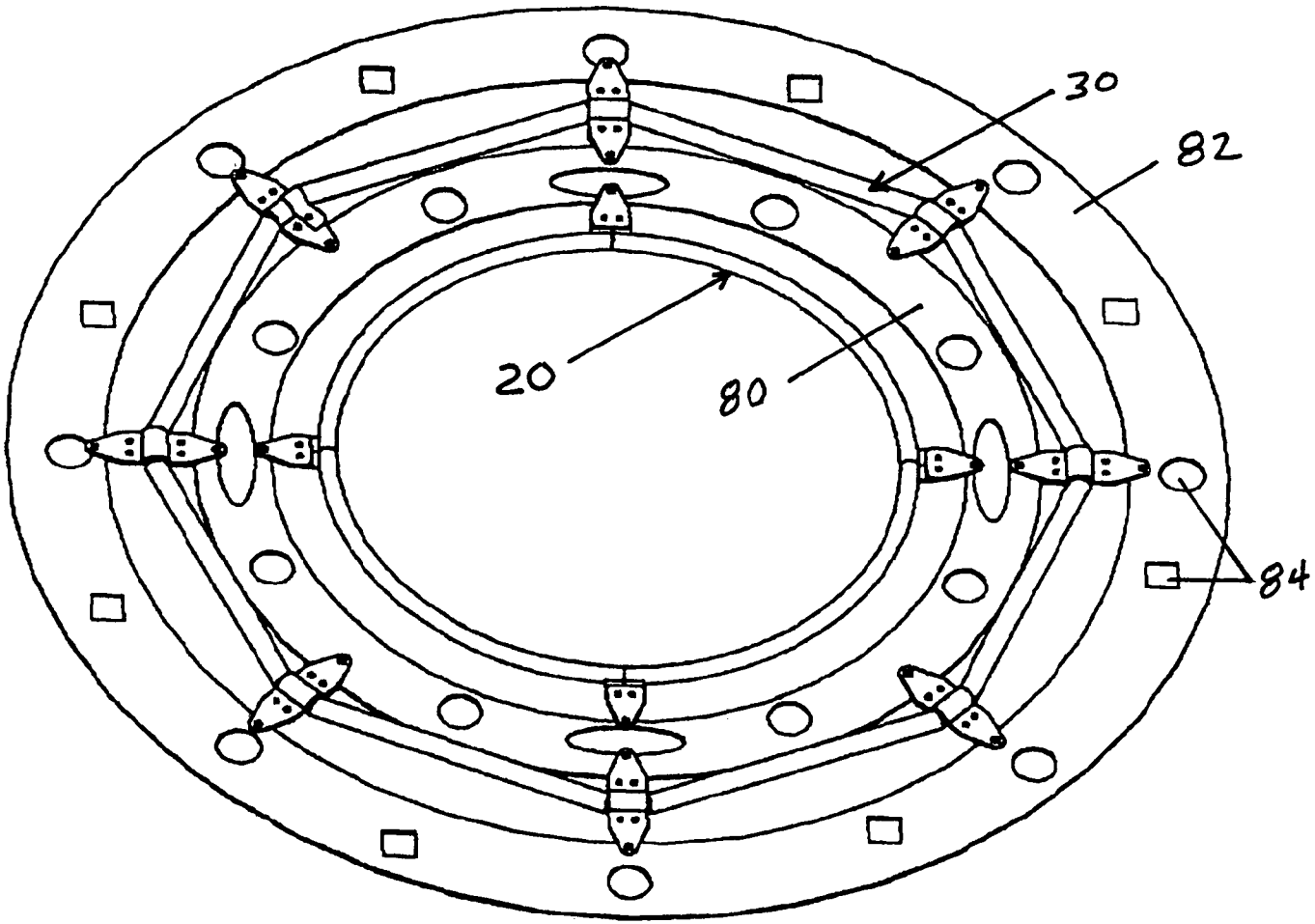
Figure 9:
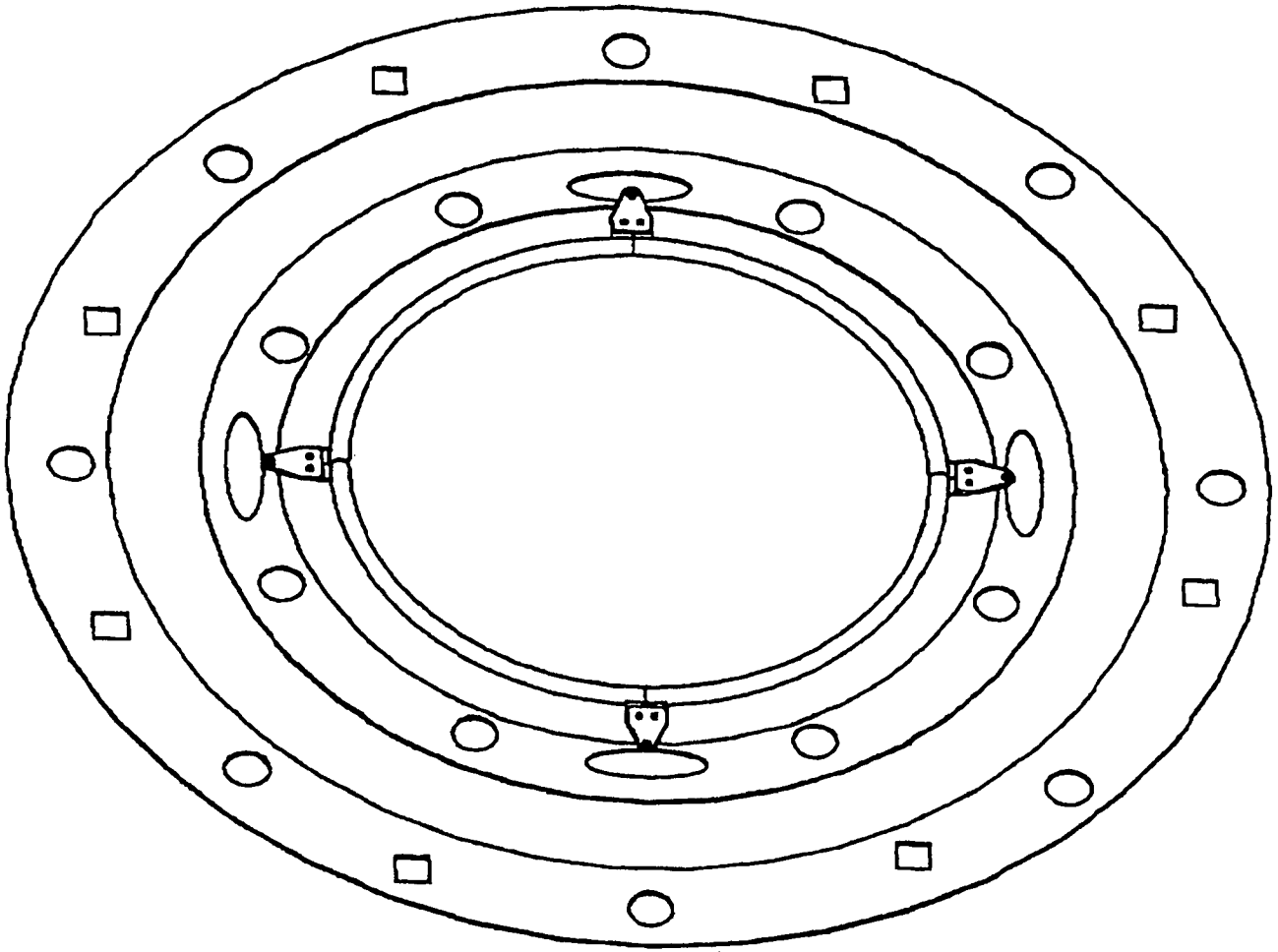
Figure 10:
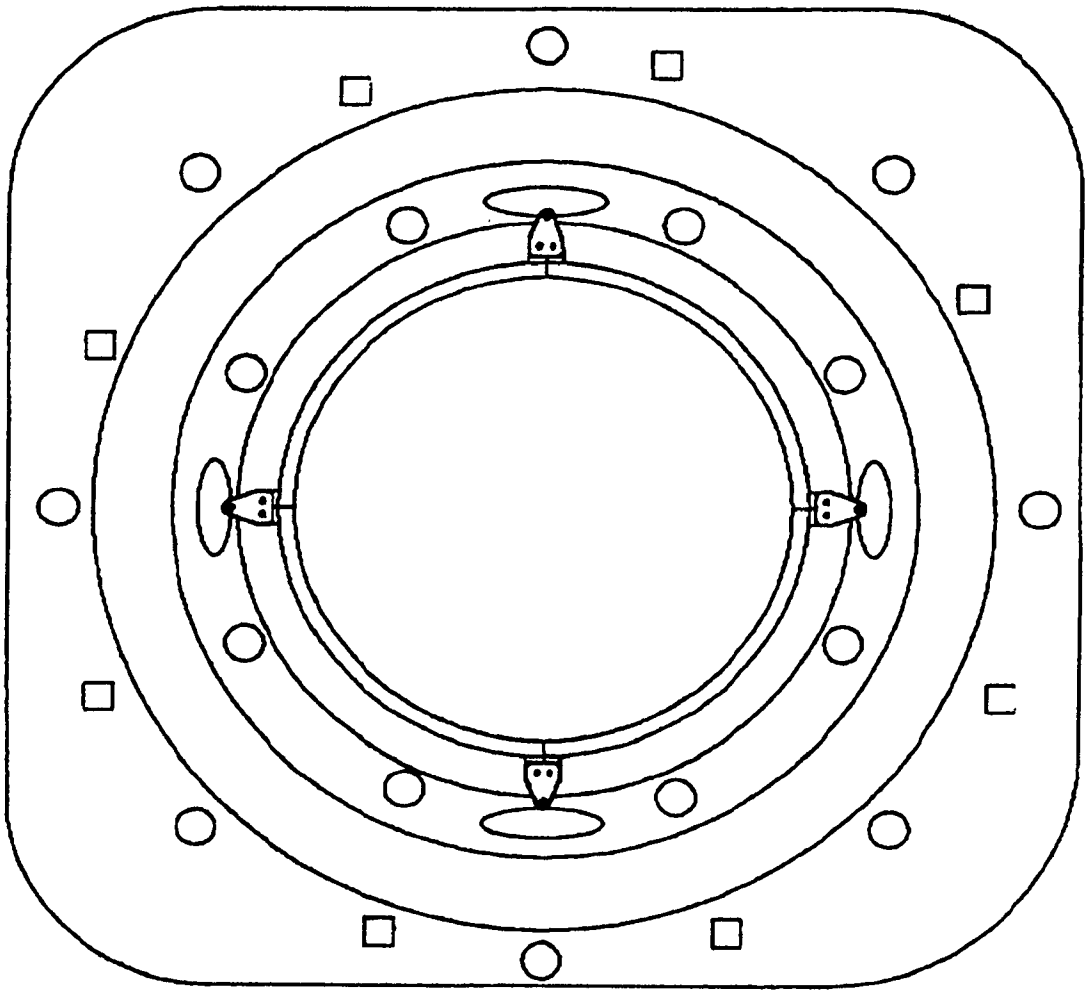
Figure 11:
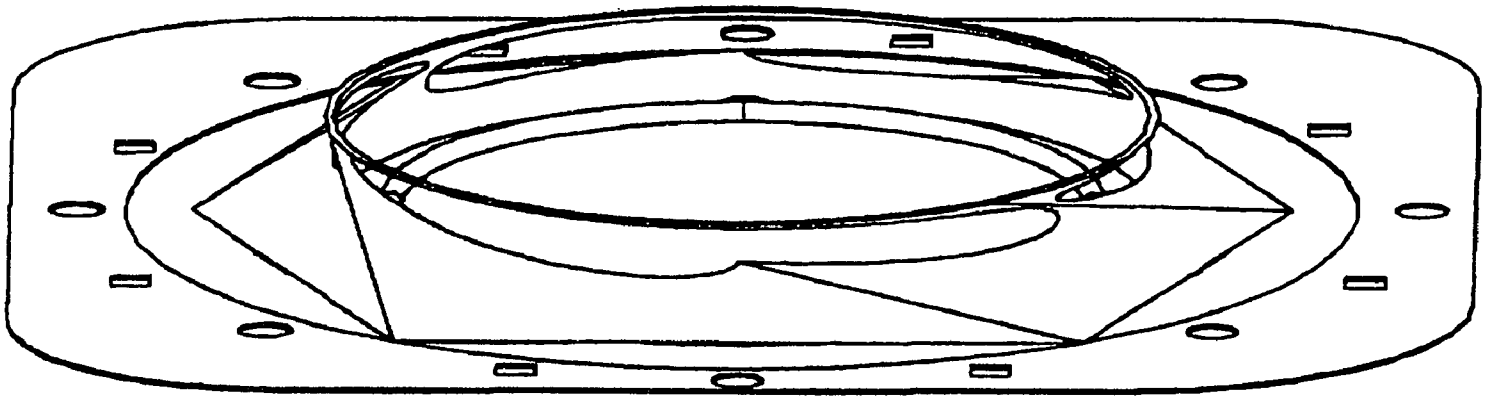
FIGS. 11-14 depict various other components for use with the present invention.
Figure 12:
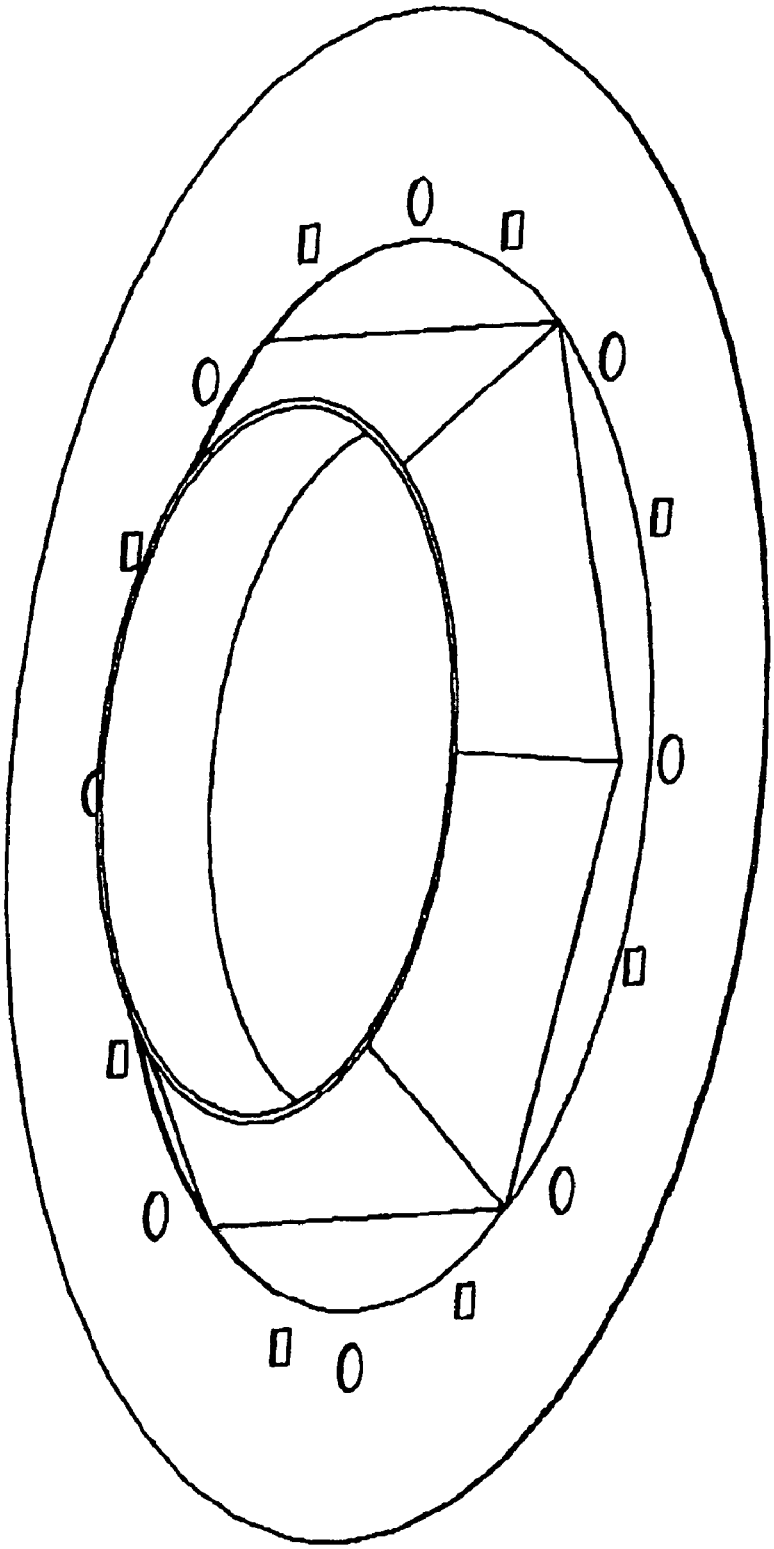
Figure 13:
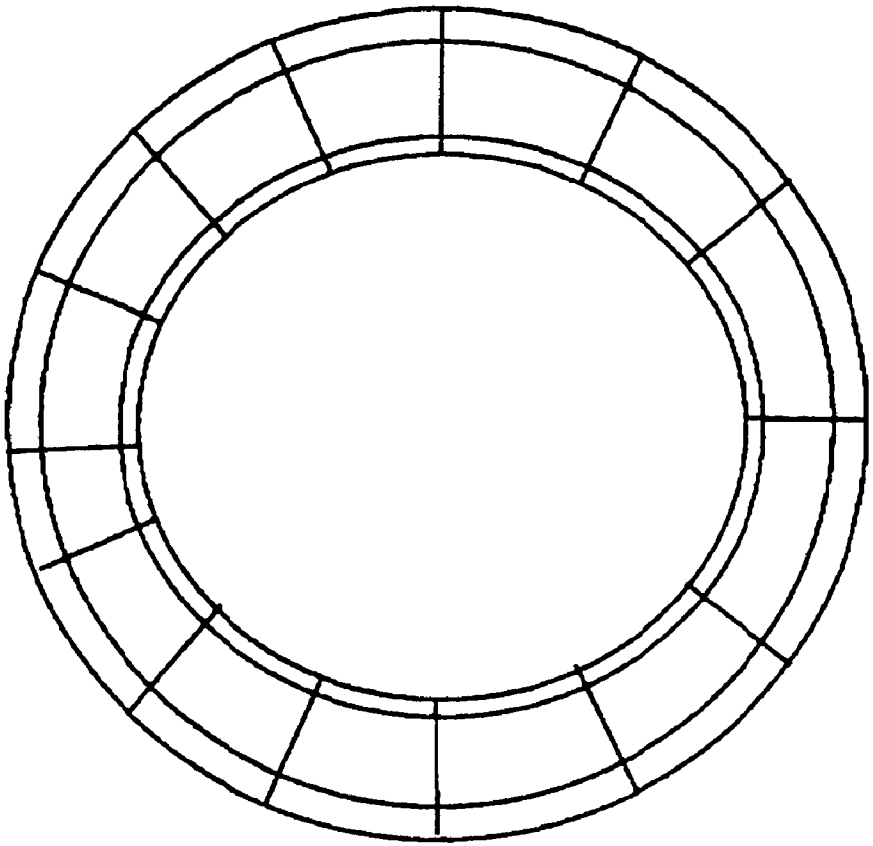
Figure 14:
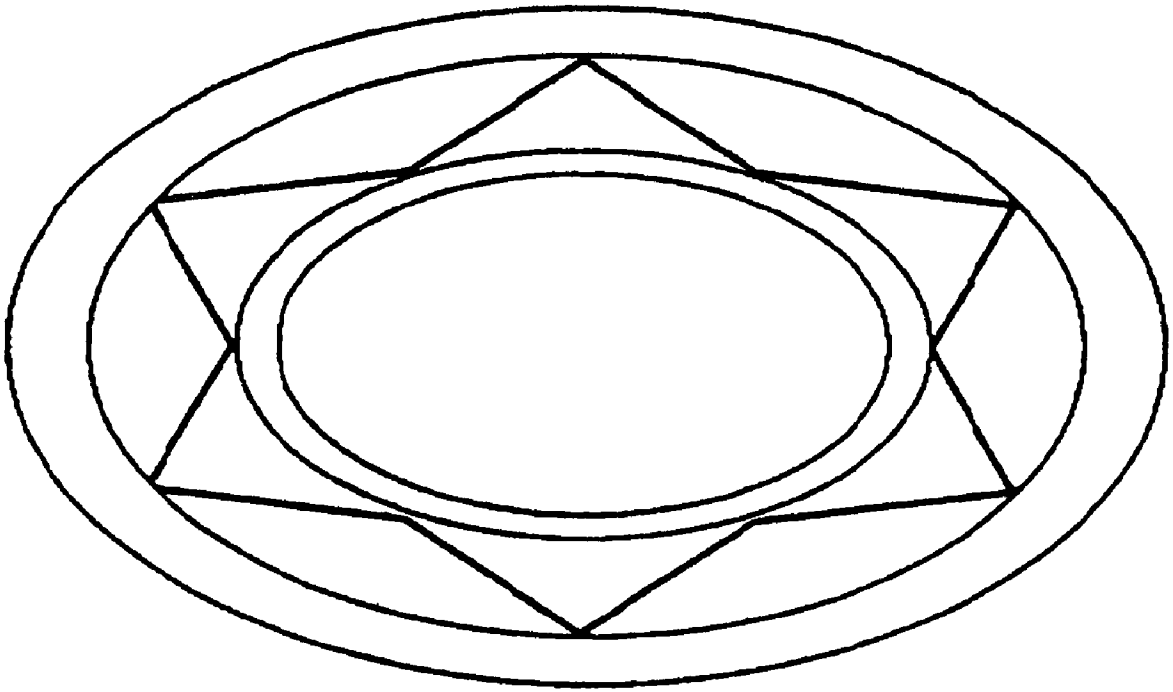

FIG. 8 depicts yet another hoop-type amusement device formed of components of the present invention. The hoop device depicted in FIG. 8 includes the hoop component 20 and octagonal component 30, and further includes a first planar circular member 80 connectedly concentrically disposed between hoop component 20 and octagonal component 30 by connection of bracket members 52. The hoop device depicted in FIG. 8 further includes a second planar circular member 82 connected to component 30 by brackets 52 in a radially outward configuration. Components 80 and 82 each define circular and non-circular cutout portions, generally referenced as 84. Similarly, FIGS. 9 and 10 depict other component combinations in accordance with the present invention. FIGS. 11 and 12 depict more complex components having distinct three-dimensional characteristics.

As should be apparent, the various components may be connected to form a virtually endless variety of complex hoop configurations thereby enhancing enjoyment. In addition, other complex hoop configurations may be formed using components disclosed herein.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A hoop-type amusement apparatus comprising:

a first hoop component;

at least one additional hoop component, said at least one additional hoop component including at least one non-annular component;

means for concentrically connecting said first hoop component and at least one additional hoop component in concentric relation, said means for concentrically connecting including brackets;

whereby complex hoop configurations may be selectively assembled by a user by connection of said components.

2. A hoop-type amusement apparatus according to claim 1, wherein said first hoop component is annular.

3. A hoop-type amusement system comprising:

a plurality hoop components, each of said hoop components including a plurality of circumferentially spaced connection points;

said plurality of hoop components includes annular and non-annular hoop components;

a plurality of brackets, said brackets selectively connectable to said connection points on said hoop components;

a plurality of connecting straps connectable to said brackets for connecting said hoop components in concentric configurations;

whereby a variety of complex hoop configurations may be formed by selective engagement of at least two of said plurality of hoop components.

* * * * *